US007210291B2

(12) United States Patent
Pfaff

(10) Patent No.: US 7,210,291 B2
(45) Date of Patent: May 1, 2007

(54) PRIORITY COMMUNICATION PROTOCOL FOR A DISTRIBUTED ELECTROHYDRAULIC SYSTEM HAVING MULTIPLE CONTROLLERS

(75) Inventor: Joseph L. Pfaff, Wauwatosa, WI (US)

(73) Assignee: HUSCO International, Inc., Waukesha, WI (US)

( * ) Notice: Subject to any disclaimer, the term of this patent is extended or adjusted under 35 U.S.C. 154(b) by 0 days.

(21) Appl. No.: 11/406,651

(22) Filed: Apr. 19, 2006

(65) Prior Publication Data

US 2006/0185354 A1 Aug. 24, 2006

Related U.S. Application Data

(63) Continuation of application No. 10/972,853, filed on Oct. 25, 2004, now abandoned.

(51) Int. Cl.
*H04L 12/40* (2006.01)
*G06F 7/00* (2006.01)
*G05B 19/414* (2006.01)

(52) U.S. Cl. ..... 60/368; 701/50

(58) Field of Classification Search ..... 60/368, 60/420; 701/50

See application file for complete search history.

(56) References Cited

U.S. PATENT DOCUMENTS 4,811,561 A * 3/1989 Edwards et al. ..... 60/368
5,371,859 A 12/1994 Lennartssojn
6,665,601 B1 * 12/2003 Nielsen ..... 701/50
6,775,974 B2 8/2004 Tabor
6,880,331 B1 * 4/2005 Hulse et al. ..... 60/368
2003/0005820 A1 1/2003 Hudson et al.

FOREIGN PATENT DOCUMENTS

EP 0 926 349 6/1999

* cited by examiner

*Primary Examiner*—Thomas E. Lazo
(74) *Attorney, Agent, or Firm*—Quarles & Brady LLP; George E Haas

(57) ABSTRACT

A distributed hydraulic system having a plurality of hydraulic functions each including a hydraulic actuator, a valve assembly that controls flow of fluid to the hydraulic actuator, and a function controller which operates the valve assembly. The function controllers exchange messages over a communication network which has a finite bandwidth. Access to the network is controlled by determining which function controllers govern high priority operations and allowing those function controllers to send messages as often as once every first interval of time. The other function controllers are limited to sending messages no more often than once every second interval of time, which is longer than the first interval of time.

12 Claims, 1 Drawing Sheet

PRIORITY COMMUNICATION PROTOCOL FOR A DISTRIBUTED ELECTROHYDRAULIC SYSTEM HAVING MULTIPLE CONTROLLERS

CROSS-REFERENCE TO RELATED APPLICATIONS

This application is a continuation of U.S. patent application Ser. No. 10/972,853 filed on Oct. 25, 2004 now abandoned.

STATEMENT REGARDING FEDERALLY SPONSORED RESEARCH OR DEVELOPMENT

Not Applicable

BACKGROUND OF THE INVENTION

1. Field of the Invention

The present invention relates to electrohydraulic systems for powering components on a vehicle, and more particularly to a distributed hydraulic system having multiple actuators operated by a plurality of electronic controllers that exchange control messages over a communication network on the vehicle.

2. Description of the Related Art

With reference to FIG. 1, a backhoe 10 is a well known type of earth moving vehicle that has a bucket 12 rotatably attached to the end of an arm 14 that in turn is pivotally coupled by a boom 16 to a tractor 18, thereby forming a boom assembly 15. A hydraulic boom cylinder 21 raises and lowers the boom 16 with respect to the tractor 18 and a hydraulic arm cylinder 22 pivots the arm 14 about the end of the boom. The bucket 12 is rotated at the remote end of the arm 14 by a hydraulic bucket cylinder 23.

Traditionally, the boom assembly 15 is controlled by valves located within the cab of the tractor 18 and mechanically connected to levers which the operator manipulates to independently move the boom, arm and bucket. A separate valve is provided for each of the cylinders 21–23 on the boom assembly 15. Operating one of the valves controls the flow of pressurized hydraulic fluid from a pump on the tractor to the associated cylinder and controls the return of fluid from that cylinder back to the tank on the tractor. A separate pair of hydraulic conduits runs from each cylinder along the boom assembly to the respective valve in the operator cab. Each of these conduits is subject to fatigue as they flex with motion of the boom assembly.

There has been a recent trend away from mechanically operated valves to electrohydraulic valves that are operated by electrical signals. Electrical valve operation enables computerized control of the functions on the machine. In addition, hydraulic control now can be distributed throughout the machine by locating the valves for a given hydraulic function in close proximity to the hydraulic actuator, such as a cylinder or motor for example, being operated by those valves. Such distributed control reduces the amount of plumbing on the machine. A single hydraulic fluid supply conduit and a single fluid return conduit connect all the valve assemblies to the pump and tank on the tractor 18.

The operator in the cab of the tractor 18 with a distributed hydraulic system manipulates joysticks or other input devices to generate electrical control signals for operating the valve assemblies located adjacent each of the boom assembly cylinders 21, 22 and 23. U.S. Pat. No. 6,718,759 describes a velocity based system for controlling a hydraulic system with multiple function in which a velocity command is produced for machine functions in response to the corresponding joystick signals. The velocity command and other signals for a given machine function are transmitted over a shared communication network to a separate function controller which is associated with the valve assembly that controls the hydraulic cylinder for that machine function. Each function controller is located in close proximity to the associated valve assembly. The function controllers also send data and other messages over the communication network to the system controller.

A common communication network 56 used in vehicle control systems is the Controller Area Network (CAN) defined by the ISO 11898 standard, promulgated by the International Organization for Standardization in Geneva, Switzerland. In addition to servicing the hydraulic system, the communication network also carries commands and data regarding operation of the engine, transmission and other components on the vehicle. The advantage of using an standardized communication network, as compared to a network that uses a proprietary communication protocol, is that vehicle devices from many manufacturers are able to communicate over that network. However, a drawback of a standardized communication network is that protocol parameters are fixed and can not be varied to meet the requirements of a given device manufacturer. With a distributed hydraulic control system, for example, the data transmission rate can not be changed to enable a greater amount of messages to be communicated between the various controllers in a given time period. Therefore the communication network 56 has a finite bandwidth that limits the number of messages that it is able to carry. As a consequence, if numerous devices are competing for access to the network in order to send a message, a given device may have to wait a relatively long time before sending its message and that message may not arrive at the recipient device in a timely manner. Thus feedback signals and other operations may be delayed which erode the robustness of machine performance.

SUMMARY OF THE INVENTION

A distributed hydraulic system has a plurality of hydraulic functions at different locations on a vehicle which receive fluid under pressure from a source. Each hydraulic function includes a hydraulic actuator, a valve assembly that controls flow of fluid to the hydraulic actuator, and an electronic function controller which operates the valve assembly. The function controllers send messages over a shared communication network in the vehicle.

A method for controlling the distributed hydraulic system comprises determining a given electronic function controller on the vehicle as generating messages which have a higher priority than messages from other electronic function controllers. The given function controller is enabled to send messages over the communication network more frequently than the other function controllers. Specifically the given function controller is able to send messages as often as periodically at a first time interval. The other electronic function controllers on the vehicle are limited to sending messages over the communication network no more often than once every second time interval, that is longer than the first time interval.

In one embodiment of this control method, a hydraulic fluid pressure level required by each hydraulic function is determined, thereby forming a plurality of hydraulic fluid pressure levels. Then a given hydraulic function that requires the greatest one of the plurality of hydraulic fluid pressure levels is identified. The function controller associated with that given hydraulic function is selected as the given electronic function controller that may send messages more frequently over the communication network.

In another aspect of the present control method, the greatest one of the plurality of hydraulic fluid pressure levels is employed to control a pressure level produced by the source. In particular, that greatest one of the plurality of hydraulic fluid pressure levels is communicated to a controller that operates an unloader valve in the source to selectively connect an outlet of a pump to a tank of the distributed hydraulic system on the vehicle.

DETAILED DESCRIPTION OF THE INVENTION

Figure 1:
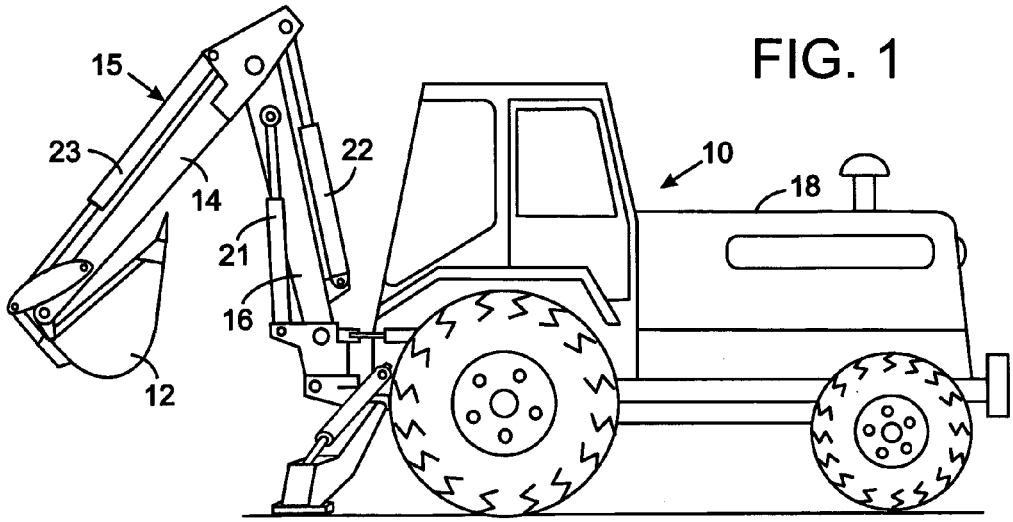
FIG. 1 is a side view of a backhoe incorporating the present invention.
Figure 2:
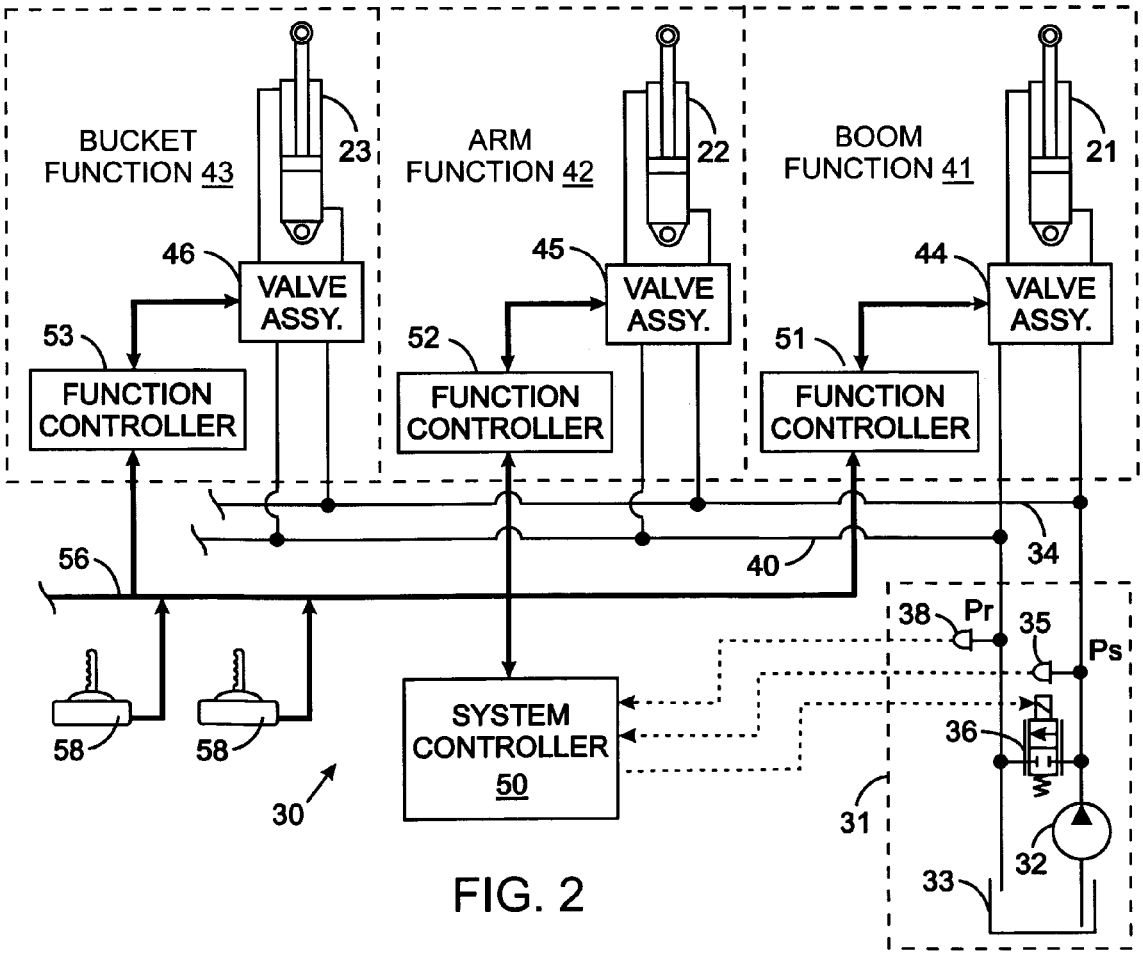
FIG. 2 is a schematic diagram of a hydraulic system for moving a boom, an arm and a bucket on the backhoe.

Referring initially to FIG. 2, a hydraulic system 30 for controlling operation of the backhoe boom assembly 15 includes a fluid source 31 that has a fixed displacement pump 32 which draws fluid from a tank 33 and forces that fluid under pressure into a supply conduit 34. The supply conduit 34 furnishes pressurized fluid to a boom function 41, an arm function 42, and a bucket function 43, which respectively operate the boom cylinder 21, the arm cylinder 22 and the bucket cylinder 23. Fluid returns from these three functions 41–43 to the tank 33 via a return conduit 40. The supply conduit 34 and the return conduit 40 extend from the pump and tank 32 and 33 located in the tractor 18 of the backhoe 10 along both the boom 16 and the arm 14. Other functions, such as for swinging the boom assembly 15 or operating stabilizers, also can be connected to the supply and return conduits 34 and 40. Although the present method is being described in the context of a machine that employs hydraulic cylinders, it should be understood that the inventive concepts can be used with other types of hydraulic actuators, such as a motor that produces rotational motion, for example.

The outlet pressure Ps from the pump 32 is measured by a first sensor 35, which provides a signal indicating that pressure to a system controller 50. An unloader valve 36 is operated by the system controller 50 to regulate pressure in the supply conduit 34 by relieving some of the fluid to the tank 33. Other hydraulic systems utilize a variable displacement pump, which would be operated by the system controller 50. The system controller 50 also receives a signal from a second pressure sensor 38 that measures the pressure Pr in the tank return conduit 40.

Each hydraulic function 41–43 respectively includes one of the hydraulic cylinders, a valve assembly, and an electronic function controller. Specifically, the boom function 41 has a first valve assembly 44 that selectively applies the pressurized fluid from the supply conduit 34 to one of the chambers of the boom cylinder 21 and drains fluid from the other cylinder chamber to the return conduit 40. A second valve assembly 45 in the arm function 42 controls the flow of hydraulic fluid to and from the arm cylinder 22 and the supply and return conduits 34 and 40. The bucket function 43 has a third valve assembly 46 that couples the chambers of the bucket cylinder 23 to the supply and tank conduits 34 and 40. Each of the valve assemblies, 44–46 is located adjacent the respective hydraulic cylinder 21, 22 and 23 to form a distributed control system. Any of a number of conventional configurations of electrical operated valve elements can be employed in each valve assembly 44–46, such as described in U.S. Pat. No. 6,328,275.

Operation of the valve assemblies 44, 45, and 46 is controlled by a separate function controller 51, 52 and 53, respectively. Each function controller is co-located along the boom assembly 15 with the associated valve assembly. The function controllers 51–53 receive operational commands from the system controller 50 and the joysticks 25 and send data to the system controller. Those commands and data are exchanged via a communication network 56, such as the Controller Area Network (CAN) serial bus that uses the communication protocol defined by ISO 11898 promulgated by the International Organization for Standardization in Geneva, Switzerland, for example. Communication network 56 also carries other messages between the engine, transmission, other components, and computers on the vehicle.

The system controller 50 and the function controllers 51–53 incorporate microcomputers that execute software programs which perform specific tasks assigned to the respective controller. The system controller 50 supervises the overall operation of the hydraulic system 30. To produce movement of a given hydraulic cylinder 21–23 on the boom assembly 15, the backhoe operator manipulates the corresponding joystick 58 to produce a command that indicates the movement desired. Each joystick 58 has circuitry that transmits its command via the communication network 56 to the function controller 51, 52 or 53 that operates the respective hydraulic cylinder 21, 22 or 23. The joystick commands also are received by the system controller 50.

Each function controller 51, 52 and 53 has a look-up table that converts the joystick command into a velocity command specifying the desired direction and speed that the associated hydraulic cylinder is to move. A given function controller responds to that velocity command and to pressures sensed at the ports of the associated valve assembly 44, 45 or 46, respectively, by determining how to operate that valve assembly in order to achieve the commanded velocity of the designated cylinder. A given machine function 41–43 may operate in different metering modes depending upon the external force acting on the cylinder and the desired direction of motion. In powered extension and retraction metering modes, fluid from the supply conduit 34 is applied to one chamber of the function's cylinder 21–23 and all the fluid exhausting from the other cylinder chamber flows into the return conduit 40. In the high side regeneration mode, fluid exiting one cylinder chamber is provided to the other cylinder chamber through a valve assembly node that is connected to the supply conduit 34. In the low side regeneration mode, fluid exiting one cylinder chamber is supplied to the other cylinder chamber through a valve assembly node that is connected to the return conduit 40. Additional fluid required by the cylinder in a regeneration mode is obtained from either the supply or return conduit 34 and 40, and excess exhausted fluid is fed into the other conduit.

Once the metering mode to use has been determined, the function controller 51, 52 or 53 employs the commanded velocity and pressure input signals to derive an equivalent flow coefficient which characterizes either fluid flow resistance or the conductance of the conduits, valves, cylinder and other hydraulic components in the associated function. From that equivalent flow coefficient, a separate valve flow coefficient is derived for each valve element in the corresponding valve assembly 44–46. The valve flow coefficients define the degree to which the respective valve element must open to provide the requisite amount of fluid flow to the hydraulic cylinder 21–23 being operated. Based on each valve flow coefficient, an electrical current is produced and applied to the electrical actuator of the corresponding valve element. The operation of the system controller 50 and the function controllers 48–52 is described in U.S. Pat. No. 6,718,759, which description is incorporated by reference herein.

In order that each machine function 41–43 achieves the commanded velocity, the system controller 50 must operate the unloader valve 36 to produce a pressure level in the supply conduit 34 which meets the requirements of all the functions. This is accomplished by each function controller 51–53 deriving a function supply pressure setpoint, which designates the pressure level required from the supply conduit 34 by the respective function. Derivation of the function supply pressure setpoint is based on the respective function's commanded velocity, selected metering mode, equivalent flow coefficient, cylinder characteristics, and pressures at ports of the associated valve assembly using a process described in the aforementioned patent. Each function controller 51–53 sends its function supply pressure setpoint to the system controller 50 over the communication network 56. The greatest of these function supply pressure setpoints is selected by the system controller as the source supply pressure setpoint, that is used in operating the unloader valve 36 to produce the specified pressure level in the supply conduit 34. Regulating the supply conduit pressure at the greatest function supply pressure setpoint ensures that all the functions receive fluid at a pressure that is sufficient to meet their needs. The function controllers 51–53 are informed via the communication network 56 of each change of the source supply pressure setpoint.

Key to the performance of the hydraulic system 30 is the efficient and timely exchange of the command and data messages over the communication network 56. For example, if a function controller 51–53 does not promptly receive the velocity command from the associated joystick 58, the respective hydraulic cylinder 21–23 will not operate in a timely manner. Similarly if the system controller 50 does not promptly receive the function supply pressure setpoints from the function controllers 50, the supply conduit 34 will not convey fluid at the proper pressure required to operate the hydraulic cylinders at the commanded velocities.

On previous machines, every controller sent its data to the other devices periodically at constant intervals. However, the typical vehicle communication network 56 used in vehicles, such as the ISO 11898 Controller Area Network, requires that the messages conform to a well defined protocol, that among other defined parameters limits the rate at which message bits can be transmitted. That transmission rate thereby limits how often a given device on the network is able to transmit its data and commands without interfering with the ability of the other devices to transmit their messages. This limitation can prevent the function controllers on a machine from being able to send their data frequently enough so that the source 31 can be operated by the system controller to provide the requisite supply conduit pressure.

The possibility of that operational deficiency is minimized in the present hydraulic system 30 by designating certain controllers with high priority control requirements as being able to communicate over the network 56 more frequently than other controllers. Whether a given function controller 51–53 qualifies as having a high priority control requirement changes from time to time and thus its communication incidence also changes.

As described previously, the system controller 50 selects the greatest supply pressure setpoint required by the functions 41–43 as the source supply pressure setpoint for use in controlling the unloader valve 36. This necessitates that the system controller monitors that greatest pressure level more often than pressure levels demanded by the other functions. As a result, the function controller 51, 52 or 53 associated with the function demanding the greatest supply pressure be allowed to communicate with the system controller 50 relatively often, i.e. more often that other function controllers.

Every function controller 51–53 has an network access rate variable stored in its memory that specifies the incidence at which that controller may send a message to over the communication network 56. When a given function controller is informed that it has the greatest supply pressure setpoint, that function controller sets its network access rate variable to a predefined value which corresponds to a relatively short message transmission interval (e.g. 10 milliseconds), referred to herein as a first interval. The other function controllers, including the one that previously sent data at the first interval, upon determining that they are not demanding the greatest supply pressure, set their network access rate variables to a longer transmission interval (e.g. 100 milliseconds), referred to herein as a second interval. The given function controller thus is able to send messages as often as once every first interval, while the other function controllers may send messages only as often as once every second interval. Therefore, the given function controller, whose pressure requirements are being used to control the supply conduit pressure PS at the source 31, sends its pressure requirement over the communication network 56 more frequently than the other function controllers. The pressure requirements of those other function controllers are less important for system control purposes as long as one of them is not demanding the greatest supply conduit pressure, in which case that one other function controller will be designated for more frequent message transmission.

In some hydraulic systems, pressure in the return conduit 40 also is regulated by operating an additional proportional control valve that couples the return conduit to the tank 33. In this instance, the return conduit pressure required by each function also is determined and the greatest of those pressure requirements is used to operate the tank control valve. Here another function controller, for the function demanding the greatest return conduit pressure, also may be designated to send messages more frequently over the communication network 56.

In other situations, a particular controller 50–54 may always have relatively high priority messages to send via the communication network 56 because of the function being controlled or operations being performed. In which case, that particular controller always will be enabled to transmit messages more often at the first interval. There may be more that two different communication intervals to which a particular controller can set its incidence of communication depending upon the relative priority of that controller's operations.

Therefore, the present process dynamically designates which controller or controllers 50–54 need high priority access to the communication network 56 and enable those controllers to send messages more frequently that other network devices.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. For example, the present hydraulic system control method can be utilized to control other functions than those associated with a boom assembly, and on other types of machines, than just backhoes. In addition, a greater or lesser number of functions than that provided in the exemplary hydraulic system 30 can be controlled. Accordingly, the scope of the invention should be determined from the following claims and not limited by the above disclosure.

What is claimed is:

1. In a hydraulic system having a plurality of hydraulic functions on a vehicle which receive fluid under pressure from a source, wherein each hydraulic function includes a hydraulic actuator, a valve assembly that controls flow of fluid to the hydraulic actuator, and an electronic function controller that operates the valve assembly, and each function controller sends messages over a communication network, a method for controlling the hydraulic system comprising:

acquiring data indicating a dynamically varying operating condition for each of the plurality of hydraulic functions;

in response to the dynamically varying operating conditions, enabling a first electronic function controller to send messages over the communication network once every first time interval;

enabling a second electronic function controller to send messages over the communication network once every second time interval that is less than the first time interval; and limiting other electronic function controllers to sending messages over the communication network less often than once every first time interval.

2. The method as recited in claim 1 wherein the other electronic function controllers are limited to sending messages over the communication network at intervals that are at least ten times longer than the first time interval.

3. The method as recited in claim 1 wherein:

enabling the first electronic function controller comprises setting a network access rate variable to a value indicating the first time interval; and limiting other electronic function controllers comprises setting at least one other network access rate variable to a value indicating a time interval that is longer than the first time interval.

4. In a hydraulic system having a plurality of hydraulic functions at different locations on a vehicle which receive fluid under pressure from a source, wherein each hydraulic function includes a hydraulic actuator, a valve assembly that controls flow of fluid to the hydraulic actuator, and an electronic function controller that operates the valve assembly, and each function controller sends messages over a communication network in the vehicle, a method for controlling the hydraulic system comprising:

in response to an instantaneous operating condition of at least one of the plurality of hydraulic functions, determining a given electronic function controller on the vehicle as generating messages which have a higher priority than messages from other electronic function controllers;

enabling the given electronic function controller to send messages over the communication network once every first time interval by setting a network access rate variable to a value indicating the first time interval; and limiting other electronic function controllers on the vehicle to sending messages over the communication network no more often than once every second time interval that is longer than the first time interval by setting at least one other network access rate variable to a value indicating a time interval that is longer than the first time interval.

5. The method as recited in claim 4 wherein the second time interval is at least ten times longer than the first time interval.

6. The method as recited in claim 4 further comprising acquiring data indicating an operating condition for each of the plurality of hydraulic functions, wherein that data is used in determining a given electronic function controller.

7. The method as recited in claim 4 wherein limiting other electronic function controllers comprises setting a separate network access rate variable for each of the other electronic function controllers to a value indicating a time interval that is longer than the first time interval.

8. The method as recited in claim 4 further comprising enabling one of the electronic function controllers to send messages over the communication network once every third time interval that is less than the first time interval.

9. In a hydraulic system having a plurality of hydraulic functions on a vehicle which receive fluid under pressure from a source, wherein each hydraulic function includes a hydraulic actuator, a valve assembly that controls flow of fluid to the hydraulic actuator, and an electronic function controller that operates the valve assembly, and each function controller sends messages over a communication network in the vehicle, a method for controlling the hydraulic system comprising:

acquiring data indicating a dynamically varying operating condition for each of the plurality of hydraulic functions;

determining, in response to the dynamically varying operating conditions, a given electronic function controller as generating messages which have a higher priority than messages from other electronic function controllers;

enabling the given electronic function controller to send messages over the communication network once every first time interval by setting a network access rate variable to a value indicating the first time interval; and limiting other electronic function controllers to sending messages over the communication network less often than once every first time interval by setting at least one other network access rate variable to a value indicating a time interval that is longer than the first time interval.

10. The method as recited in claim 9 wherein the other electronic function controllers are limited to sending messages over the communication network at intervals that are at least ten times longer than the first time interval.

11. The method as recited in claim 9 wherein limiting other electronic function controllers comprises for each of the other electronic function controllers setting a separate network access rate variable to a value indicating a time interval that is longer than the first time interval.

12. The method as recited in claim 9 further comprising enabling one of the electronic function controllers to send messages over the communication network once every second time interval that is less than the first time interval.

* * * * *